US010306965B2

(12) United States Patent
Wilkinson et al.

(10) Patent No.: US 10,306,965 B2
(45) Date of Patent: Jun. 4, 2019

(54) HAND HELD APPLIANCE

(71) Applicant: Dyson Technology Limited, Wiltshire (GB)

(72) Inventors: Christopher Daniel Currer Wilkinson, Swindon (GB); Antoine Francois Atkinson, Swindon (GB); Christopher William Hedges, Guildford (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 338 days.

(21) Appl. No.: 15/159,077

(22) Filed: May 19, 2016

(65) Prior Publication Data

US 2016/0338464 A1 Nov. 24, 2016

(30) Foreign Application Priority Data

May 22, 2015 (GB) ..... 1508811.5

(51) Int. Cl.
*A45D 20/12* (2006.01)
*A45D 20/10* (2006.01)
*A45D 20/00* (2006.01)

(52) U.S. Cl.
CPC ..... *A45D 20/10* (2013.01); *A45D 20/00* (2013.01); *A45D 20/12* (2013.01)

(58) Field of Classification Search
CPC ..... A45D 20/12; A45D 20/30
USPC ..... 34/96, 283, 520, 341, 343, 505, 522, 34/332.2, 330; 219/702, 715, 721, 414
See application file for complete search history.

(56) References Cited

U.S. PATENT DOCUMENTS 1,564,896 A 12/1925 Rinker et al.
1,654,896 A 1/1928 Rawson
1,821,525 A 9/1931 Nielsen
(Continued)

FOREIGN PATENT DOCUMENTS

DE 7737196 12/1977
DE 2742615 4/1979
(Continued)

OTHER PUBLICATIONS

Search Report dated Sep. 29, 2016, directed to EP Application No. 16 17 0120; 7 pages.
(Continued)

*Primary Examiner* — John P McCormack
(74) *Attorney, Agent, or Firm* — Morrison & Foerster LLP

(57) ABSTRACT

A hand held appliance comprising a fluid flow path extending from a fluid inlet into the appliance to a fluid outlet from the appliance, the fluid flow path being at least partially defined by a wall, a switch mechanism housed by the wall having a cooperating externally accessible actuating button and a switch cover extending within the wall and containing the switch mechanism. The switch cover may maintain a spatial location of the switch mechanism relative to the actuating button. The switch cover may encase the switch mechanism. The switch cover may isolate the switch mechanism from the fluid flow path. The switch cover may maintain a spatial location of the switch mechanism relative to the wall. The switch cover may be curved towards an upstream end to reduce disturbance to the flow of fluid within the fluid flow path.

15 Claims, 6 Drawing Sheets

(56) References Cited

U.S. PATENT DOCUMENTS

| | | | | |
|---|---|---|---|---|
| 3,209,127 | A | 9/1965 | Graves | |
| 4,232,454 | A | 11/1980 | Springer | |
| 5,841,943 | A | 11/1998 | Nosenchuck | |
| 5,875,562 | A * | 3/1999 | Fogarty | A45D 20/10 34/97 |
| 6,088,531 | A | 7/2000 | Endoh | |
| 6,148,537 | A | 11/2000 | Altamore | |
| 2006/0166711 | A1 | 7/2006 | Schworm | |
| 2011/0079239 | A1 | 4/2011 | Hall | |
| 2013/0045084 | A1 | 2/2013 | Tu et al. | |
| 2013/0111777 | A1 | 5/2013 | Jeong | |
| 2015/0007854 | A1 | 1/2015 | Moloney et al. | |

FOREIGN PATENT DOCUMENTS

| | | |
|---|---|---|
| DE | 2754304 | 6/1979 |
| DE | 3101933 | 9/1982 |
| EP | 0300281 | 7/1988 |
| GB | 955966 | 4/1964 |
| GB | 2482548 | 2/2012 |
| JP | 53-5178 | 1/1978 |
| JP | 54-150252 | 11/1979 |
| JP | 58-32706 | 3/1983 |
| JP | 61-75203 | 5/1986 |
| JP | 2002-238649 | 8/2002 |
| JP | 2004-113776 | 4/2004 |
| JP | 2005-192588 | 7/2005 |
| JP | 2005-533459 | 11/2005 |
| JP | 2015-13127 | 1/2015 |
| KR | 20-0206074 | 12/2000 |
| KR | 20-0206089 | 12/2000 |

OTHER PUBLICATIONS

Search Report dated Oct. 16, 2015, directed to GB Application No. 1508811.5; 3 pages.

* cited by examiner

HAND HELD APPLIANCE

REFERENCE TO RELATED APPLICATIONS

This application claims the priority of United Kingdom Application No. 1508811.5, filed May 22, 2015, the entire contents of which are incorporated herein by reference.

FIELD OF THE INVENTION

This invention relates to a hand held appliance and in particular a hair care appliance.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet to the blower. The fan and heater require power in order to function and this is provided via internal wiring from either a mains power cable or batteries attached to the appliance.

Conventionally, a hairdryer has a body and a handle with a fluid flow path within the body and the controlling electronics within the handle i.e. removed from the fluid flow path. However, there are hairdryers where at least some of the fluid flows in the vicinity of the electronic controls and this can cause difficulties particularly when the hairdryer is used in humid environments.

SUMMARY OF THE INVENTION

According to embodiments of the invention, a hand held appliance comprises a fluid flow path extending from a fluid inlet into the appliance to a fluid outlet from the appliance, the fluid flow path being at least partially defined by a wall, a switch mechanism housed by the wall having a cooperating externally accessible actuating button and a switch cover extending within the wall, the switch cover housing the switch mechanism.

Preferably, the switch cover maintains a spatial location of the switch mechanism relative to the actuating button.

In a preferred embodiment, the switch cover encases the switch mechanism.

Preferably, the switch cover isolates the switch mechanism from the fluid flow path.

In a preferred embodiment, the switch cover maintains a spatial location of the switch mechanism relative to the wall.

Preferably, the switch cover is curved towards an upstream end to reduce disturbance to the flow of fluid within the fluid flow path.

In a preferred embodiment, the wall has an inner surface and an outer surface, the fluid flow path being at least partly defined by the inner surface of the wall wherein, the inner surface of the wall comprises a lip which extends from the inner surface.

Preferably, the lip engages with the switch cover to define a location of the switch cover with respect to the wall.

In a preferred embodiment, the lip engages with the switch mechanism to define a location of the switch mechanism with respect to the wall.

Preferably, the lip forms a part of a labyrinth seal around the switch mechanism.

In a preferred embodiment, the switch cover forms another part of a labyrinth seal around the switch mechanism.

Preferably, the switch mechanism includes an activation knob which cooperates with the externally accessible actuating button.

In a preferred embodiment, the switch cover additionally houses a second switch.

Preferably, the appliance is a hair care appliance.

Preferably, the hair care appliance is a hairdryer. Alternatively, the hair care appliance is a hot styling appliance.

BRIEF DESCRIPTION OF THE DRAWINGS

The invention will now be described, by way of example only, with reference to the accompanying drawings, in which.

DETAILED DESCRIPTION OF THE INVENTION

Figure 1:
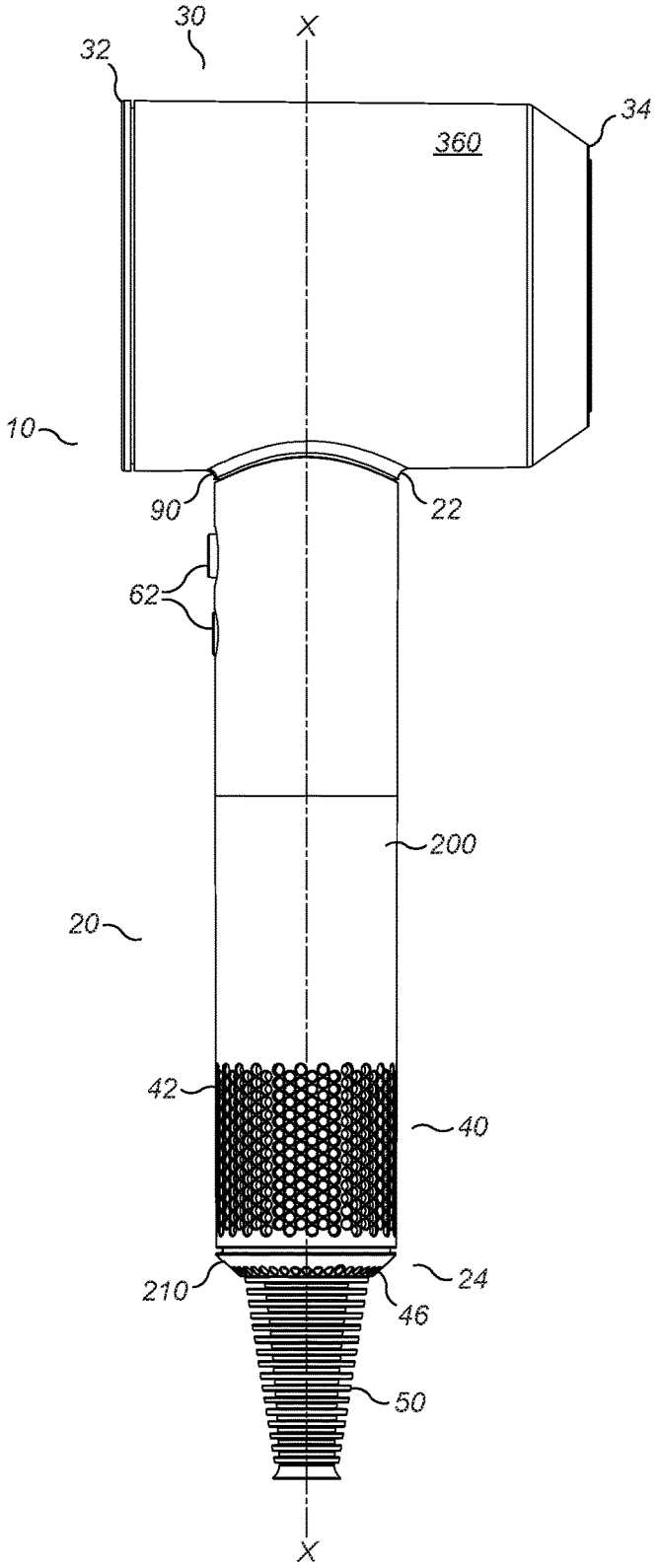
FIG. 1 shows a hairdryer according to the invention.
Figure 2:
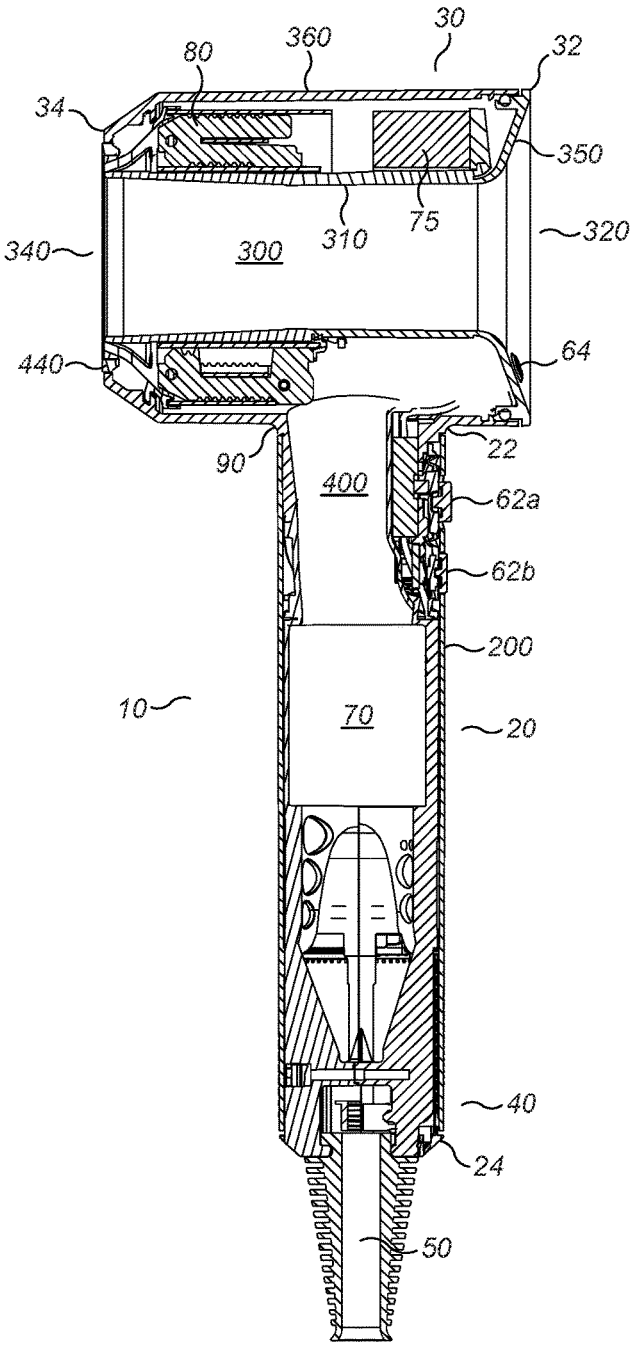
FIG. 2 shows a cross section through the hairdryer of FIG. 1.
Figure 3:
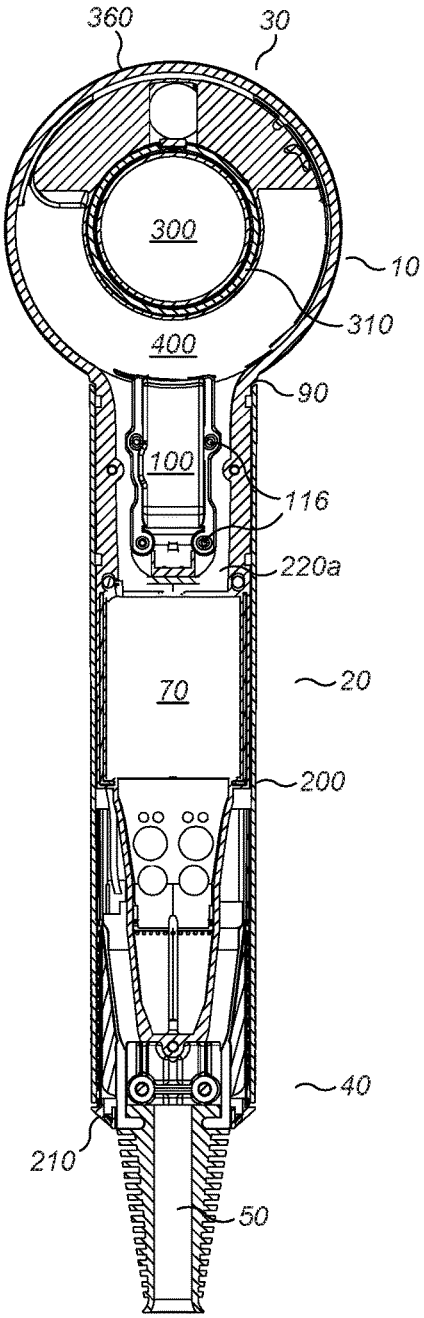
FIG. 3 shows a further cross section through the hairdryer of FIG. 1.
Figure 4:
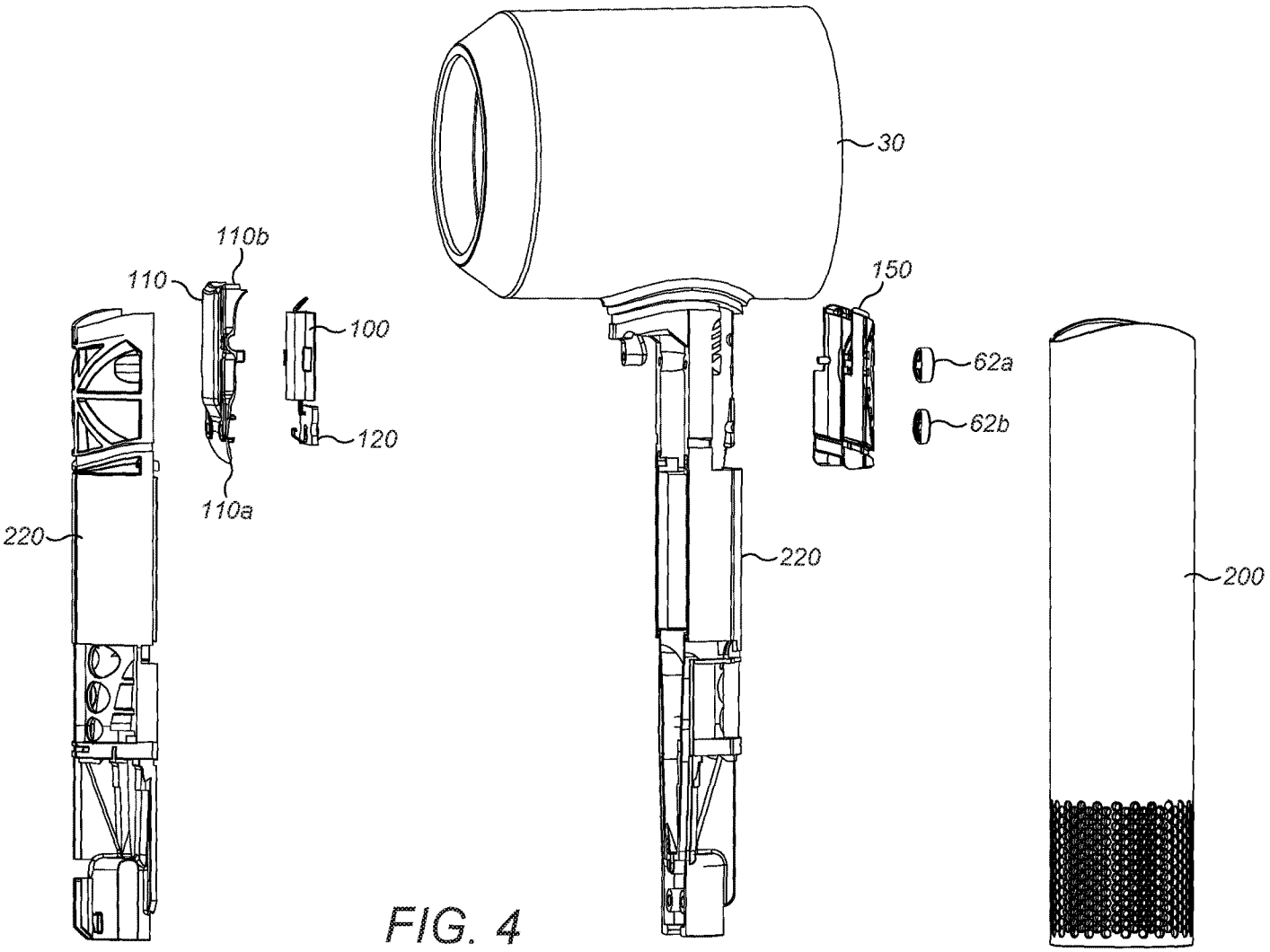
FIG. 4 shows an exploded view of some of the internal components of a hairdryer according to the invention.
Figure 5:
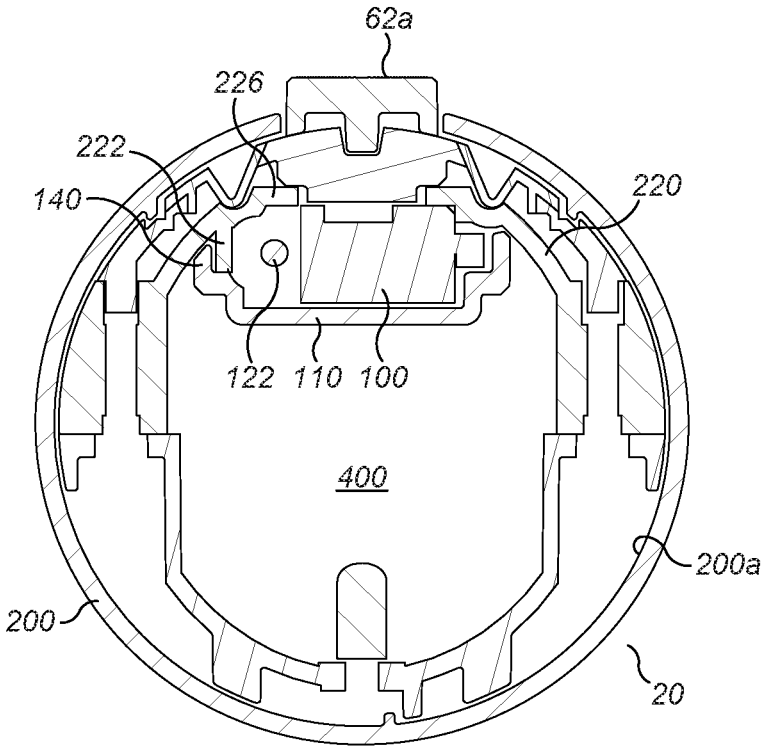
FIG. 5 is a further cross section through the handle of hairdryer shown in FIG. 1.
Figure 6:
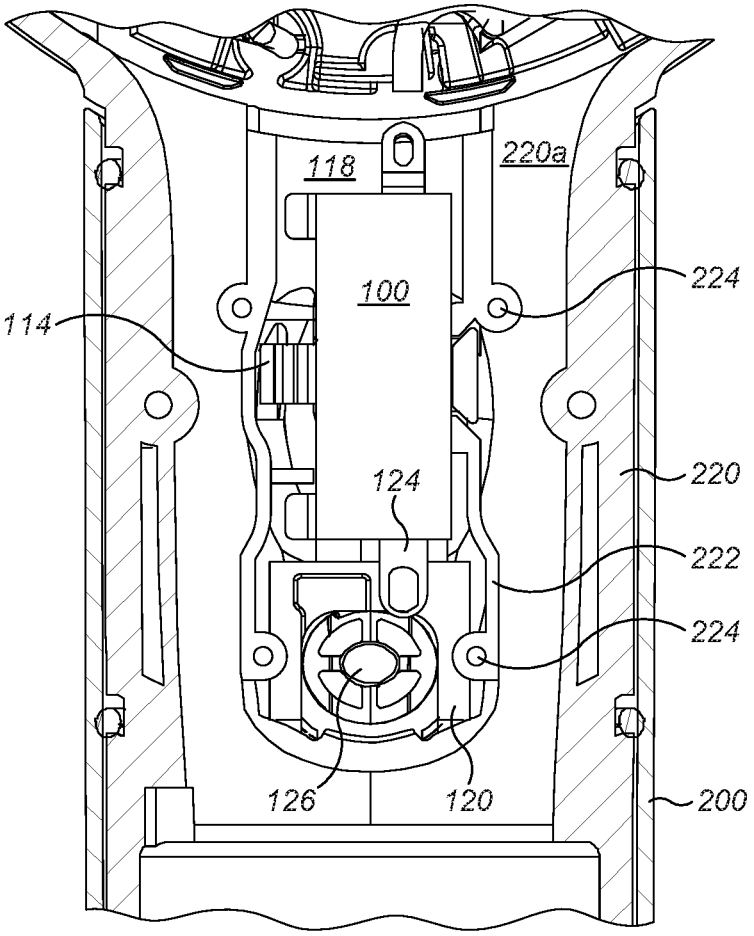
FIG. 6 is an enlarged view of a cross section through the handle of hairdryer shown in FIG. 1.
Figure 7:
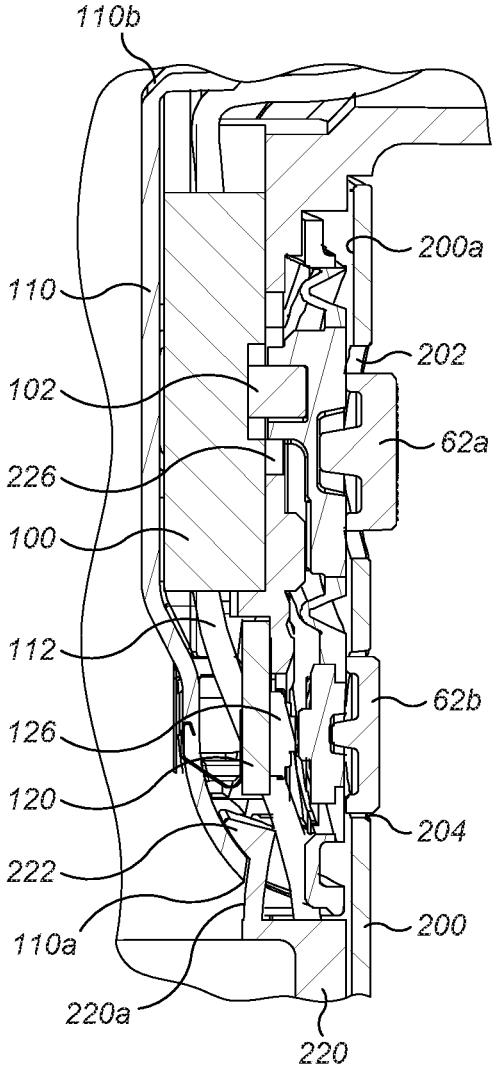
FIG. 7 is an enlarged view of the cross-section shown in FIG. 2.

FIGS. 1, 2 and 3 show a hairdryer 10 with a handle 20 and a body 30. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The handle 20 has a longitudinal axis X-X along which the outer wall 200 extends from the body 30 towards the distal end 24. The handle 20 includes an outer wall 200 which is gripped by a user and an inner wall 220 which extends within the outer wall 200.

Downstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

Another fluid flow path 300 is provided within the body 30; this flow is not directly processed by the fan unit 70 or the heater 80 but is drawn into the hairdryer 10 by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path 300.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 extends about the fluid flow path 300 and is isolated from the fluid flow path 300 by the inner duct 310.

The PCB 75 controls parameters such as the temperature of the heater 80 and the speed of rotation of the fan unit 70. Internal wiring (not shown) electrically connects the PCB 75 to the heater 80 and the fan unit 70 and the cable 50. The internal wiring includes a live wire 112 and a neutral wire 122 that extend from the cable towards the switch mechanism. Control buttons 62, 64 are provided and connected to the PCB 75 to enable a user to select from a range of temperature settings and flow rates for example. The control buttons 62, 64 are actuated by a user to change the state of a parameter of the hairdryer.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 3, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Referring now to FIGS. 2 to 7 in particular, the invention will now be described. The primary fluid flow path 400 flows from the primary fluid inlet 40 through the handle 20 and into the body 30 to the primary fluid outlet 400. On the handle, a first set of control buttons 62 are provided. These control buttons 62 for example include an on/off button 62*a* and a cold shot button 62*b*. Each of the control buttons 62*a*,62*b* cooperates with a switch mechanism. In this example, the on/off control button 62*a* cooperates with a switch mechanism 100 such that activation of the on/off control button 62*a* causes activation of the switch mechanism 100 via an activation knob 102. When a user activates the on/off control button 62*a*, the on/off control button slides and engages with the activation knob 102 moving it from the off position to the on position or vice versa.

The control buttons 62*a*, 62*b* cooperate with their respective switches 100, 120 through apertures 202, 204 in the outer wall 200. The control buttons 62*a*, 62*b* engage with their respective switches directly or indirectly. In this embodiment the control buttons 62*a*, 62*b* engage indirectly with their switches via an switch assembly 150 which forms part of an inner wall 220 of the handle 20. The switch assembly 150 is a flexible barrier to block ingress of dirt etc. into the fluid flow path. The switch assembly 150 engages directly with both the control button 62*a* and the activation knob 102 so any movement of the control button 62*b* is reflected by a corresponding movement of the activation knob 102.

Alternatively, the control buttons 62*a*,62*b* engage directly with their respective switches 100,120 in which case the inner wall 220 and the switch assembly 150 can be dispensed with. In this embodiment, the switch cover 110 is attached to an inner surface 200*a* of the outer wall 200 of the handle 20.

The switch mechanism 100 is housed within a switch cover 110 which is attached to an inner surface 220*a* of the inner wall 220 of the handle 20. The switch cover 110 has a number of functions: to retain the switch mechanism 100 in its location with respect to the control button 62*a*, to provide a controlled change in cross section for the fluid flow path 400, and to reduce the chance of dirt and fluid ingress into the controls of the hairdryer.

The switch cover 110 is attached to the inner wall 220. The inner wall 220 is provided with an aperture 226 through which the activation knob 102 of switch 100 protrudes in order to cooperate with the control button 62*a*. This in turn retains the switch mechanism 100 in position with respect to the control button 62*a* either by direct contact between the activation knob 102 and the control button 62*a* or via the switch assembly 150.

The inner surface 220*a* of the inner wall 220 is shaped to receive and retain the switch cover 110. The inner surface 220*a* is provided with a lip 222 which extends radially inwards of the inner wall 220. The switch cover 110 has an outer edge 140 which extends over the lip 222 and is retained in position via screws 116 which engage with screw holes 224 in the lip 222. The lip 222 engages with the switch cover 110 to define a location of the switch cover 110 with respect to the inner wall 220.

In addition to housing the switch mechanism 100, the switch cover 110 routes a live wire 112 through a wire holder 124 and into the switch mechanism 100 to enable the hairdryer to be switched on and off. The neutral wire 122 (FIG. 5) is routed passed the switch mechanism 100 and retained in a position using a wire clip 114.

A second switch comprising a PCB extension 120 which includes an electronic switch 126 to enable a user to activate and deactivate the cold shot button 62*b* is also housed within the switch cover 110. The switch cover 110 additionally maintains the spatial location of this switch with respect to the control button 62*b*.

The switch cover 110 is shaped to reduce disturbance of fluid flowing within the primary fluid flow path 400. The switch cover 110 has an upstream end 110*a* which is positioned towards the primary fluid inlet 40 and a downstream end 110*b* which is positioned towards the primary fluid outlet 440. The upstream end 110*a* curves away from the inner surface 220*a* of the inner wall 220 providing a gradual decrease in the cross-sectional area of the primary fluid flow path 400 to provide room to accommodate the switch 100. This causes less disturbance to the flow of fluid which reduces pressure loss and noise created by the switch cover 110.

The combination of the lip 222 and the switch cover 110 provides a convoluted path or a labyrinth seal to prevent fluid and dirt from entering the cavity 118 housing the switch mechanism 100. The lip 222 enables the switch cover 110 and the switch mechanism 100 to be accurately positioned with respect to the inner wall 220 of the handle 20 and to the control button 62*a*.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hand held appliance comprising:

a fluid flow path extending from a fluid inlet into the appliance to a fluid outlet from the appliance, the fluid flow path being at least partially defined by a wall, a switch mechanism housed between the wall and a switch cover that extends within the wall and covers the switch mechanism, the switch mechanism having a cooperating externally accessible actuating button, wherein the wall has an inner surface and an outer surface, the fluid flow path being at least partly defined by the inner surface of the wall, wherein the inner surface of the wall comprises a lip which extends from the inner surface and engages with the switch cover to define a location of the switch cover with respect to the wall.

2. The appliance of claim 1, wherein the switch cover maintains a spatial location of the switch mechanism relative to the actuating button.

3. The appliance of claim 1, wherein the switch cover encases the switch mechanism.

4. The appliance of claim 3, wherein the switch cover isolates the switch mechanism from the fluid flow path.

5. The appliance of claim 1, wherein the switch cover maintains a spatial location of the switch mechanism relative to the wall.

6. The appliance of claim 1, wherein an upstream end of the switch cover is curved to reduce disturbance to the flow of fluid within the fluid flow path.

7. The appliance of claim 1, wherein the lip engages with the switch mechanism to define a location of the switch mechanism with respect to the wall.

8. The appliance of claim 1, wherein the lip forms a part of a labyrinth seal around the switch mechanism.

9. The appliance of claim 8, wherein the switch cover forms another part of a labyrinth seal around the switch mechanism.

10. The appliance of claim 1, wherein the switch mechanism includes an activation knob which cooperates with the externally accessible actuating button.

11. The appliance of claim 1, wherein the switch cover additionally houses a second switch.

12. The appliance of claim 1, wherein the appliance is a hair care appliance.

13. The appliance of claim 12, wherein the hair care appliance is a hairdryer.

14. The appliance of claim 1, wherein the switch cover at least partially covers at least one wire connected to the switch mechanism.

15. The appliance of claim 1, wherein the switch mechanism is housed in a cavity formed at least partially by the wall and the switch cover.

* * * * *